United States Patent [19]

Schüller

[11] Patent Number: 4,819,344

[45] Date of Patent: Apr. 11, 1989

[54] SHOE, IN PARTICULAR LADIES HIGH-HEELED SHOE

[76] Inventor: Günter Schüller, Bergstrasse 24, 5060 Bergisch-Gladbach 2, Fed. Rep. of Germany

[21] Appl. No.: 132,277

[22] Filed: Dec. 14, 1987

[30] Foreign Application Priority Data

Dec. 18, 1986 [DE] Fed. Rep. of Germany ... 8633827[U]

[51] Int. Cl.[4] ..... A43B 21/42; A43B 21/36

[52] U.S. Cl. ..... 36/35 A; 36/34 R; 36/42

[58] Field of Search ..... 36/35 A, 36 R, 36 C, 36/35 C, 36 A, 42, 35 R, 34 R

[56] References Cited

U.S. PATENT DOCUMENTS

| | | | |
|---|---|---|---|
| 2,263,186 | 11/1941 | Parkhurst | 36/42 |
| 2,932,098 | 4/1960 | Lange | 36/34 R |
| 2,935,799 | 5/1960 | Ronci | 36/42 |
| 2,966,750 | 1/1961 | Maret | 36/35 R |
| 4,729,178 | 3/1988 | Bovchet | 36/35 A |

FOREIGN PATENT DOCUMENTS

| | | | |
|---|---|---|---|
| 764162 | 8/1967 | Canada | 36/34 R |
| 8513594 | 10/1986 | Fed. Rep. of Germany . | |
| 1183854 | 7/1959 | France | 36/34 R |
| 1266662 | 6/1961 | France | 36/34 R |
| 1273675 | 9/1961 | France | 36/42 |
| 329922 | 5/1930 | United Kingdom | 36/42 |
| 2166338 | 5/1986 | United Kingdom | 36/42 |

*Primary Examiner*—Steven N. Meyers
*Attorney, Agent, or Firm*—Martin A. Farber

[57] ABSTRACT

A shoe, in particular a ladies high-heeled shoe, has a heel tap (3) fastened by means of a pin (4) to the heel (1), the pin having a head (13) which passes, secured against rotation, through a hole in the heel tap. The pin extends, with an expansion seat, within an expansion sleeve (6) of the heel and has a longitudinal bore (17) of circular cylindrical shape into which an expansion nail is driven. The expansion nail (18) has a non-circular cross section.

17 Claims, 4 Drawing Sheets

FIG.9
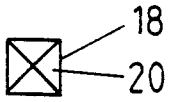
FIG.5
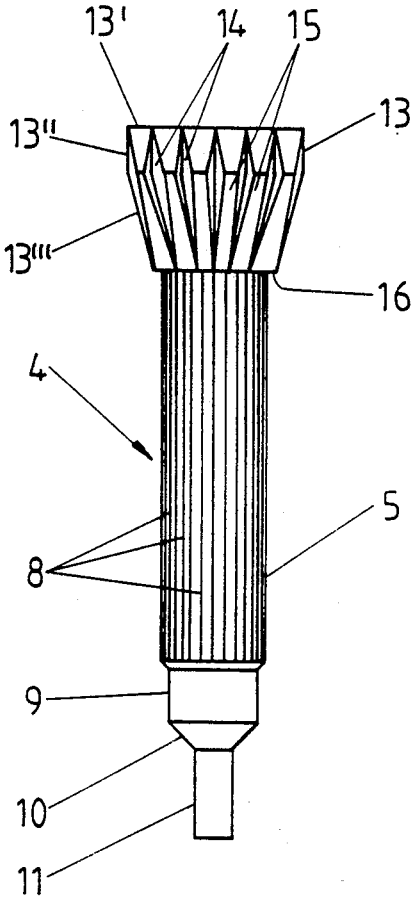
FIG.7
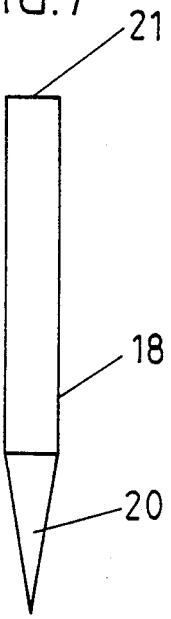
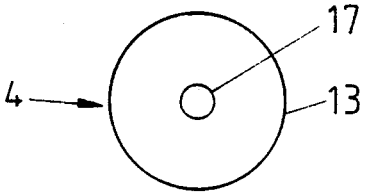
FIG.6
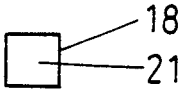
FIG.8

SHOE, IN PARTICULAR LADIES HIGH-HEELED SHOE

FIELD AND BACKGROUND OF THE INVENTION

A shoe, in particular a ladies high-heeled shoe has a heel tap fastened to the heel by means of a pin, the pin having a head which passes, fixed against rotation, through an opening in the heel tap. The pin is seated with spread seat in a clamping sleeve of the heel and has a circular-cylindrical longitudinal bore into which an expansion nail is driven.

From Federal Republic of Germany Utility Model No. 83 15 594.1 it is known to secure a heel tap which is developed as a plate against twisting by an axial ribbing on the head of the pin; the shank of the pin is seated in a clamping sleeve which is driven into the heel. Upon the hammering in of the pin, the sleeve comes into a sort of force fit with respect to the longitudinal bore of the heel in which the shank is received. Despite the relatively high clamping action obtainable, the danger of the twisting of the heel tap out of its congruent position with respect to the surface of the heel is not entirely excluded.

It has therefore been attempted to solve this problem by driving an expansion nail into a central circular-cylindrical longitudinal bore specifically provided for this purpose. This also failed to provide a satisfactory solution for securing against twisting.

The object of the present invention is to optimize the securing against twisting by structurally simple means and without increasing the number of basic parts.

This object is achieved by the invention set forth in the ensuing description.

SUMMARY OF THE INVENTION

In accordance with the invention, there is provided a shoe, in particular a ladies high-heeled shoe, with heel lift or tap (3) fastened by an expandable pin (4) to the heel (1). The pin has a frustoconical expandable head (13) which extends forming an expansion seat non-rotatably through a hole in the heel tap and the pin extends forming an expansion seat within an expansion sleeve (6) of the heel. The pin and head have a longitudinal bore (17) of circular cylindrical shape into which an expansion nail (18) is driven, the expansion nail (18) having a non-circular cross section greater than that of the longitudinal bore prior to driving the nail therein.

As a result of the invention, the fixing of the heel tap against turning is considerably improved. Not only is the radially directed expansion action obtained as a result of the cross section of the longitudinal bore being smaller than the cross section of the expansion nail, but the protrusions which extend beyond a round cross section of the expansion nail provide extremely effective clamping ribs. The clamping pressure of these ribs continues to radiate up to the outer surface of the pin which is itself in a force fit and thus forms zones of higher clamping force.

In addition to this, the non-circular cross section has the advantage that the nonrotatable characteristic is retained even in the event of the breakage of the pin. The expansion nail provides essentially the function of an internal block against turning. It is furthermore advantageous for the expansion nail to have a rectangular, preferably square, cross section. On the one hand, such nails are available on the market; on the other hand, due to this cross section there is obtained an arrangement at an equal angle apart of the projections of rib-like protrusions which extend beyond a round cross section. Finally the invention also proposes that the pin shank adjoining the head of the pin be provided with grooves in longitudinal direction. The fine ribbing thus obtained results in a favorable roughening of the surface. This measure contributes still further to the securing against turning.

BRIEF DESCRIPTION OF THE DRAWINGS

The object of the invention is explained below in further detail with reference to an embodiment shown by way of example in the drawing, in which:

FIG. 5 is a view of the pin by itself, also enlarged;

FIG. 6 is a top view corresponding to FIG. 5;

FIG. 7 shows the expansion nail by itself;

FIG. 8 is a top view of FIG. 7;

FIG. 9 is a bottom view thereof, and

DETAILED DESCRIPTION OF THE DETAILED EMBODIMENT

Figure 1:
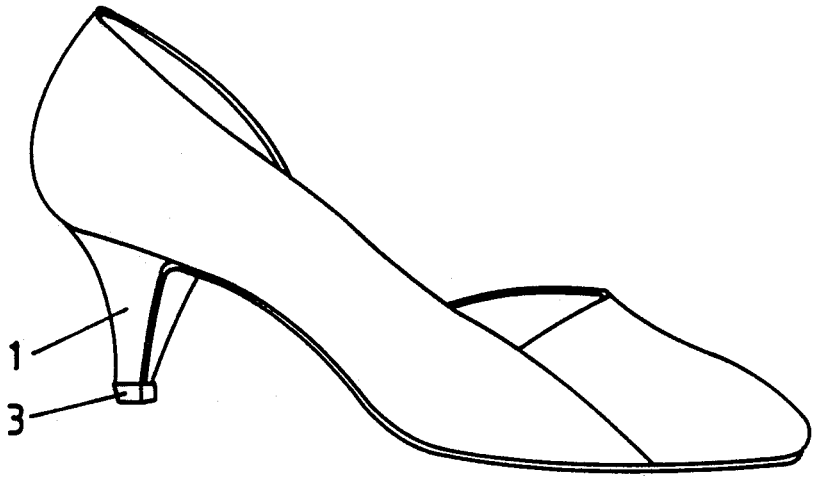
FIG. 1 shows the shoe of a pair of shoes developed in accordance with the invention, seen in perspective.
Figure 2:
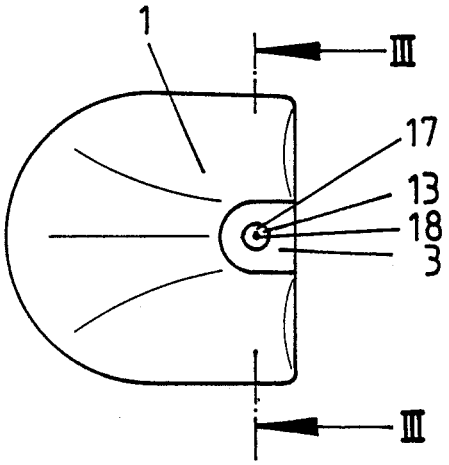
FIG. 2 is a bottom view looking at the fitted heel.

The high-heeled shoe, known as a pump, has a heel 1 which tapers down practically to the size of a penny and which is approximately stirrup-shaped in contour. Its bottom 2 is provided with a plate of congruent pattern made of plastic (PUR) or the like as so-called heel tap 3. As fastening means there is used a nail-like pin 4 of plastic which passes centrally through the plate of the heel tap 3.

For the attachment of the heel tap 3 by means of the pin 4, the cylindrical shank 5 of said pin enters with a non-twistable expanion seat into a longitudinally slit clamping sleeve 6 of steel. The latter extends within a longitudinal bore 7 in the heel 1. The shank 5, as a result of its diameter, presses the outer wall of the clamping sleeve 6 firmly, and thus in non-turnable manner, against the wall of the longitudinal bore 7.

In addition to this, for further securing against turning, the periphery of the pin shank 5 is grooved in longitudinal direction. By very narrow grooving a strong roughening is obtained. The grooves are designated 8.

The end of the pin opposite its head is reduced in cross section. On the portion which bears the grooves 8 there is seated, via a mount, a smooth cylindrical portion 9 which extends over a frustoconical portion 10 into a cylindrical portion 11 which is again reduced in cross section.

The heel tap 3 is provided in its central region with a cylindrical hole 12. This hole can be formed at the same time as the stamping out of the heel tap. The inside diameter of the hole 12 is adapted to the outside diameter of the cylindrical portion 11 of smallest cross section.

The other end of the pin 4 forms a head 13 which extends prominently beyond the cross section of the shank. Adjoining its flat head surface 13' there is first of all a cylindrical portion 13" which passes, via a frustoconical portion 13"', into the cylindrical shank 5. The section 13''' accounts for about two-thirds of the length of the head, measured in axial direction.

Figure 3:
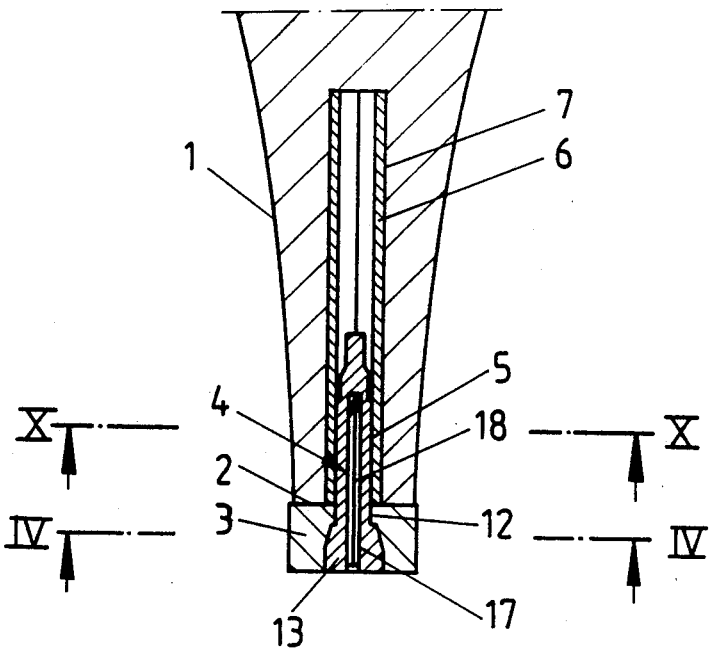
FIG. 3 is a section along the line III—III of FIG. 2 but on a larger scale than in FIG. 2.
Figure 4:
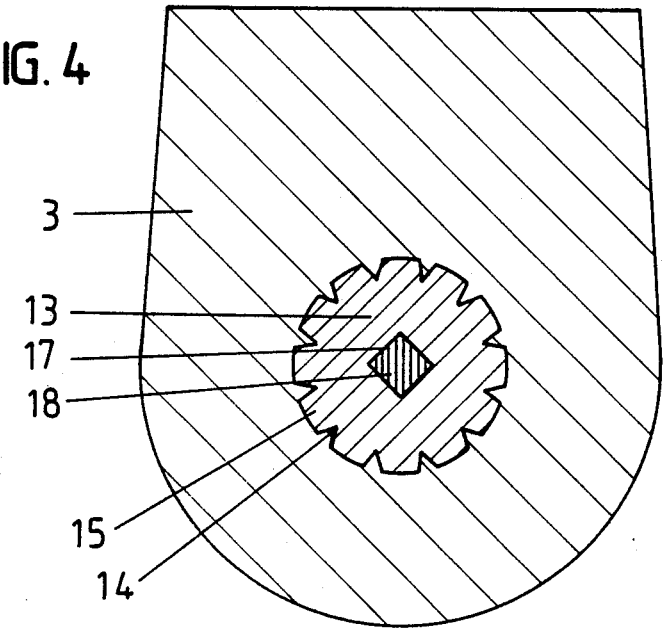
FIG. 4 is a section along the line IV—IV of FIG. 3, on a still larger scale.
Figure 10:
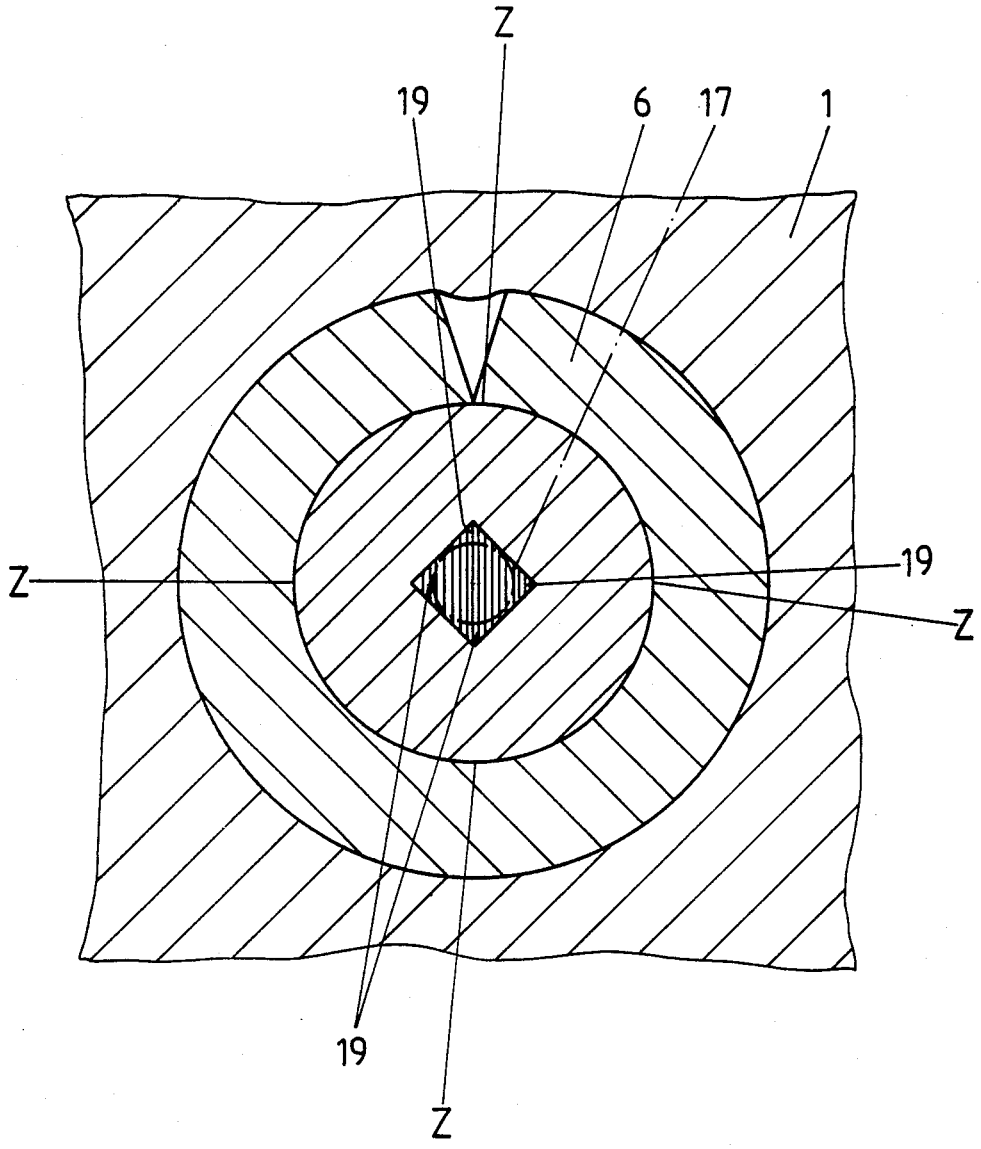
FIG. 10 is a section along the line X—X of FIG. 3.

Over the entire length of the wall of the head there extend in axial direction longitudinal grooves 14 of V-notched shape which leave ribs 15 between themselves. These ribs dig into the wall of the hole 12 and/or the material of the wall presses itself into the longitudinal grooves 14. There thus results a toothed connection as assurance against rotation between the heel tap 3 and the pin 4. The head 13 has a shorter axial length than the thickness of the heel tap. Between the head and shank 5 of the pin 4 there can also remain a shoulder 16, as can be noted from FIGS. 3 and 5.

The pin 4 has a central longitudinal bore 17 of circular cylindrical shape. The bore commences from the head 13 and terminates within the region of the cylindrical section 9 of the shank 5 and serves to receive an expansion nail 18. The latter has a non-circular cross section. In the embodiment shown, a square cross section has been selected. The diameter of the longitudinal bore 17, which is the same over its entire length, is kept somewhat smaller than the lateral dimension of the expansion nail which is of square cross section. This results in a clamping action which increases the clamping seat between pin 5 and clamping sleeve 6, which favors the assurance against turning. In addition to this the protrusions 19 of the corner zones which are formed by the non-circular cross section optimize this effect. These protrusions radially displace the material lying in front of their corner vertex. Corresponding to the cross-sectional shape selected, there are in this way obtained four zones Z of increased clamping force in circumferential direction.

The expansion nail 18 has a pyramid-shaped nail point region 20. Its head, on the other hand, is flat and not thickened. In its driven condition the flat head end 21 is recessed axially behind the head surface 13' of the pin 4.

The expansion seat which is produced from the inside and the non-circular bridge between shank 5 and head 13 of the pin assure continuation of the non-turnability even if the shank should break.

The pin 4 can be already pre-assembled to the heel tap 3 so that this unit can be attached as a whole; another conceivable possibility, in particular, for repairs, consists in the customary placing of the heel tap 3 on the bottom 2 of the heel and the driving in the pin, whereupon the steel expansion nail 18 is hammered in.

I claim:

1. A shoe, in particular a ladies high-heeled shoe, comprising:

a heel and a heel tap;

an expandable pin fastening the heel tap to the heel, the pin having a longitudinal bore of circular cylindrical shape;

an expandable sleeve disposed within the heel; and an expansion nail; and wherein the pin has an expandable head which extends non-rotatably forming an expansion seat through a hole in the heel tap, said head has a frustoconical section extending in axial direction over a greatest portion of the axial length of said head, said longitudinal bore extends in said frustoconical section, and said pin extends, forming an expansion seat, within the expandable sleeve of the heel, the expansion nail having a non-circular cross section greater than the cross section of said longitudinal bore, said expansion nail being driven into the longitudinal bore extending up into said head and therebeyond in said pin.

2. A shoe according to claim 1, wherein said expansion nail has a rectangular cross section.

3. A shoe according to claim 2, wherein said expansion nail has a pyramid-shaped nail point pointing up in said longitudinal bore.

4. A shoe according to claim 3, wherein said expansion nail has a flat non-thickened head end on a bottom end of said expansion nail remote from said point, said head end is recessed axially in said head of said pin in said longitudinal bore spaced upward from a bottom head surface of said head of said pin.

5. A shoe according to claim 1, wherein the cross section of said expansion nail is square.

6. A shoe according to claim 1, wherein the pin has a shank with said longitudinal bore therein, and said shank adjoins the head of the pin, the shank and head having grooves oriented in longitudinal direction.

7. A shoe according to claim 1, wherein the pin has a shank with said longitudinal bore therein, and said shank adjoins the head of the pin and extends within said sleeve of the heel, said expansion nail extends with its non-circular cross-section into said longitudinal bore in said shank forming a non-circular bridge between said shank and said head of the pin, thereby preventing turning of said tap relative to said heel.

8. A shoe according to claim 1, wherein the pin has a shank with said longitudinal bore therein, and said shank adjoins the head of the pin forming a shoulder at a narrowest end of the head, said shoulder has a greater outer diameter than that of said shank.

9. A shoe according to claim 1, wherein said head of said pin has a bottom flat head surface, and said head has a cylindrical portion adjoining and between said bottom flat head surface and said frustoconical section.

10. A shoe according to claim 9, wherein said frustoconical section tapers in an upward direction away from said bottom flat head surface.

11. A shoe according to claim 1, wherein said head is made of plastic.

12. A shoe according to claim 1, wherein said frustoconical section is about two-thirds of the axial length of said head.

13. A shoe according to claim 1, wherein said head has a shorter axial length than that of the axial thickness of said tap.

14. A shoe according to claim 1, wherein said pin has a shank, and said head projects substantially greater than the cross-section of said shank of said pin.

15. A shoe according to claim 1, wherein said frustoconical section of said head is formed with substantially longitudinal ribs and grooves therebetween complementarily engaging with material of said tap by expansion force of said head by force of said expansion nail in said longitudinal bore in said head of said pin.

16. A shoe according to claim 15, wherein said grooves are V-shaped.

17. A shoe according to claim 1, wherein the cross-section of said longitudinal bore is smaller than a lateral (non-point to non-point) cross-sectional dimension of said expansion nail.

* * * * *